US007018971B2

(12) United States Patent
Akkermans et al.

(10) Patent No.: US 7,018,971 B2
(45) Date of Patent: Mar. 28, 2006

(54) PROCESS FOR THE PRODUCTION OF DETERGENT GRANULES

(75) Inventors: Johannes Hendrikus Akkermans, Vlaardingen (NL); Remy Antal Verburgh, Vlaardingen (NL)

(73) Assignee: Unilever Home and Personal Care USA division of Conopco, Inc., Greenwich, CT (US)

( * ) Notice: Subject to any disclaimer, the term of this patent is extended or adjusted under 35 U.S.C. 154(b) by 293 days.

(21) Appl. No.: 10/278,409

(22) Filed: Oct. 23, 2002

(65) Prior Publication Data

US 2003/0100471 A1 May 29, 2003

(30) Foreign Application Priority Data

Oct. 25, 2001 (GB) ..... 0125653

(51) Int. Cl.
*C11D 3/08* (2006.01)
*C11D 3/10* (2006.01)

(52) U.S. Cl. ..... 510/438; 510/276; 510/444; 510/450; 510/507; 510/481; 510/509

(58) Field of Classification Search ..... 510/276, 510/438, 444, 450, 507, 481, 509
See application file for complete search history.

(56) References Cited

U.S. PATENT DOCUMENTS

| | | | | |
|---|---|---|---|---|
| 4,264,464 | A * | 4/1981 | Gangwisch et al. | 510/323 |
| 4,721,633 | A | 1/1988 | Baldassin | 427/212 |
| 4,869,843 | A | 9/1989 | Saito et al. | 252/135 |
| 5,024,782 | A * | 6/1991 | Finn et al. | 510/444 |
| 5,205,958 | A * | 4/1993 | Swatling et al. | 510/444 |
| 5,925,614 | A * | 7/1999 | Brougham et al. | 510/444 |
| 5,929,021 | A | 7/1999 | Dhanuka et al. | 510/444 |
| 5,998,357 | A | 12/1999 | Appel et al. | 510/444 |
| 6,093,690 | A | 7/2000 | Chapman | 510/444 |
| 6,258,773 | B1 | 7/2001 | Mort, III et al. | 510/444 |
| 6,407,055 | B1 * | 6/2002 | Bauer et al. | 510/511 |
| 6,423,679 | B1 * | 7/2002 | Capeci et al. | 510/444 |
| 6,794,354 | B1 * | 9/2004 | Mort et al. | 510/444 |

FOREIGN PATENT DOCUMENTS

| | | |
|---|---|---|
| EP | 360 330 | 3/1990 |
| EP | 384 070 | 8/1990 |
| EP | 390 251 | 10/1990 |
| EP | 643 129 | 3/1995 |
| GB | 2 199 338 | 7/1988 |
| GB | 2 221 695 | 2/1990 |
| JP | 61/069.897 | 4/1986 |
| JP | 06 106990 | 4/1994 |
| WO | 96/25482 | 8/1996 |
| WO | 96/34082 | 10/1996 |
| WO | 97/22685 | 6/1997 |
| WO | 97/32002 | 9/1997 |
| WO | 98/16615 | 4/1998 |
| WO | 98/58046 | 12/1998 |
| WO | 98/58047 | 12/1998 |
| WO | 98/58048 | 12/1998 |
| WO | 99/64558 | 12/1999 |
| WO | 00/44874 | 8/2000 |
| WO | 00/77140 | 12/2000 |
| WO | 01/40428 | 6/2001 |

OTHER PUBLICATIONS

GB Search Report in GB application GB 01256536.
Co-pending application Applicant Akkermans et al. Appl. No. 10/278,408, Filed Oct. 23, 2002.
PCT International Search Report in a PCT Appl. PCT/EP 02/11895.
PCT International Search Report in a PCT Appl. PCT/EP 02/11892.
PCT International Search Report in a PCT Appl. PCT/EP 02/09115.

* cited by examiner

*Primary Examiner*—Charles Boyer
(74) *Attorney, Agent, or Firm*—Rimma Mitelman

(57) ABSTRACT

A process for the preparation of detergent granules, the process comprising:

(i) a first step of admixing in a mechanical granulator, an aluminosilicate and a first liquid binder comprising at least one surfactant, to produce a powder; and (ii) a second step of admixing in a low shear granulator, the powder produced in step (i), a water soluble salt and a second liquid binder, to produce the said detergent granules;

wherein in step (ii), no more than 2%, preferably 0% by weight of the aluminosilicate based on the weight of the detergent granules is introduced into the low shear granulator of step (ii).

10 Claims, No Drawings

PROCESS FOR THE PRODUCTION OF DETERGENT GRANULES

TECHNICAL FIELD

The present invention relates to a process for the production of detergent compositions by a granulation process in which solids and a liquid binder are mixed in a mechanical granulator and then further liquid binder is sprayed-on in a low shear granulator such as a fluid bed.

BACKGROUND OF THE INVENTION

Traditionally, detergent powders were produced by spray drying. However, the spray drying process is both capital and energy intensive and the products were quite bulky, having a relatively low bulk density.

The desire for powders with higher bulk densities led to the development of processes which employ mainly mixing, without the use of spray drying. These mixing techniques offer great flexibility in producing powders of various different compositions from a single plant, by post-dosing various components after an initial granulation stage. The resultant powders have fairly high bulk densities, which is desirable for some product forms. However, many of these non-spray drying techniques are unsuitable for production of powders over a wide bulk density range and in particular, for the production of lower bulk density powders.

One kind of process, which does not involve spray-drying, and which is capable of producing medium bulk densities between those of spray dried and other non-spray dried powders, involves use of a low shear granulator, usually a fluidised bed apparatus. Although fluidised bed granulation processes per se can give good control of bulk density, there can still be problems with poor dispensing of the resultant product.

The principle of adding a "layering agent" (usually, an aluminosilicate) in the final stage of non-spray drying mechanical granulating process for detergents is well known, for example as described in "Surfactants in Consumer Products", Springer Verlag, 1987, pp 411–413. This reference mentions that it may be applied in a fluid bed drier.

JP-A-61 06990 describes that spray dried particles may be pulverized in a mechanical granulator and mixed with a liquid binder, wherein such a layering agent may be added.

Application of an aluminosilicate in the final stage of a process involving two mechanical mixer/granulator, followed by a fluid bed drier, is disclosed in EP-A-390 251.

Processes in which detergent granules are made by spraying liquid binder onto solids in a fluidised bed apparatus are known from many references, for example WO-A-98/58046, WO-A-98/58047 and WO-A-98/58048.

A process in which a pregranulation step is effected in a high or low spaced granulator followed by a secondary granulation step in a fluid bed granulator is described in WO-A-97/22685. Preferably, a "flow aid" may be added in the pregranulator. The list of possible flow aids does not include aluminosilicate. In two examples, LAS is formed by in situ neutralisation in the pregranulator, in which some zeolite is added.

WO-A-00/44874 discloses processes for making cationic detergent granules. In one variant, an aqueous cationic surfactant solution is mixed with a water-insoluble highly absorbing material such as an aluminosilicate to form agglomerates. The agglomerates are then dried in a drier such as a fluid bed drier.

We have now found that dispensing properties are significantly improved if most or all of an aluminosilicate component is added in a pregranulation step which is followed by a further granulation step in a low shear granulator such as of fluid bed type.

DEFINITION OF THE INVENTION

The present invention provides a process for the preparation of detergent granules, the process comprising:

(i) a first step of admixing in a mechanical granulator, an aluminosilicate and a first liquid binder comprising at least one surfactant, to produce a powder; and (ii) a second step of admixing in a low shear granulator, the powder produced in step (i), a water soluble salt and a second liquid binder, to produce the said detergent granules;

wherein in step (ii), no more than 2%, preferably 0% by weight of the aluminosilicate based on the weight of the detergent granules is introduced into the low shear granulator of step (ii).

DETAILED DESCRIPTION OF THE INVENTION

The process of the present invention may be carried out in either batch or continuous mode of operation as desired.

The Liquid Binder

The term "liquid binder" refers to a material or materials that are liquids or are at least pumpable respectively at the temperature at which they enter the mechanical granulator in step (i), or the low shear granulator of step (ii). In the case of step (i), that temperature is preferably at least 80° C. and is more preferably no higher than 120° C. In the case of step (ii), that temperature is preferably, from 40° C. to 120° C. more preferably from 70° C. to 100° C.

The first liquid binder added in step (i) can have the same or a different composition as the second liquid binder added in step (ii). However, preferably the two compositions are substantially the same.

Preferably, both the first and second liquid binders comprises an anionic surfactant, a nonionic surfactant, and more preferably soap also.

The anionic surfactant may be formed in situ in the relevant granulator(s) by reaction between an acid precursor of the anionic surfactant and a neutralising agent such as an alkali metal, preferably sodium, alkali such as the carbonate, bicarbonate or hydroxide or a mixture thereof. However, preferably the anionic surfactant is introduced preneutralised, most preferably as a blend with the other components of the liquid binder.

Similarly, any soap may be formed by in situ neutralisation of a fatty acid but preferably, it is introduced as the soap per se, most preferably in a blend with the other liquid binder components.

The total water in all components applied in step (i) plus step (ii) preferably does not exceed 25 wt % of the total liquid binder, but more preferably no more than 10 wt %. If the water level is above 10%, preferably drying is carried out in step (ii) or in a subsequent stage, e.g. using heated air. The water may be added in amounts of 0.5 to 10 wt % by weight of the final detergent composition.

The Aluminosilicate

Of the aluminosilicate present in the granules produced at the end of stage (ii), preferably all is introduced in step (i)

but up to 2% by weight of this total may be dosed in step (ii). One or more different kinds of aluminosilicate may be used.

Aluminosilicates, whether crystalline and/or amorphous may suitably be present in the final granules, a total amount from 10 to 60 wt % and preferably an amount of from 15 to 50 wt % of the granulated detergent product. Optionally, up to 90%, more preferably up to 70% of this aluminosilicate may be replaced by one or more other insoluble absorbent powder materials, e.g. selected from clay, silica, and insoluble silicate salts such as magnesium silicate. The zeolite used in most commercial particulate detergent compositions is zeolite A. Advantageously, however, maximum aluminium zeolite P (zeolite MAP) described and claimed in EP-A-384,070 may be used. Zeolite MAP is an alkali metal aluminosilicate of the P type having a silicon to aluminium ratio not exceeding 1.33, preferably not exceeding 1.5, and more preferably not exceeding 1.07.

The Water Soluble Salt

The water soluble salt may comprise one or more water soluble inorganic and/or organic salt compounds. These may be chosen from inorganic water soluble salts as inorganic alkaline agents, e.g., selected from alkali metal hydroxides and silicates, alkali metal phosphate builders such as tripolyphosphates, as well as carbonated agents typically selected from one or more materials selected from alkali metal carbonates, sesqicarbonates and bicarbonates, preferably sodium salts thereof, as well as burkeite. Alternatively, or additionally, water soluble organic salts such as alkali metal salts of organic acids such as carboxylic and di- and higher-carboxylic acids, for example acetic acid, citric acid, glutaric acid and succinic acid may be used. Again, sodium salts are preferred.

Suitable non-alkaline, inorganic salts may be selected from alkali metal sulphates, chlorides.

Preferred alkali metal salts are the sodium or potassium.

Preferably, no more than 9%, of water soluble salt more preferably no more than 7% by weight based on the weight of the detergent granules is introduced into the granulator of step (i), most preferably 0%.

The total level of such salts in the granules formed at the end of step (ii) is from 7% to 30%, more preferably from 10% to 25% by weight of those granules.

Preferably, the inorganic water soluble salt has a $d_{3,2}$ average particle size no more than 90 μm, preferably no more than 80 μm, more preferably no more than 70 μm, still more preferably no more than 60 μm, yet more preferably no more than 50 μm and especially no more than 40 μm. Preferably, the minimum $d_{3,2}$ average particle size of the solid carbonated neutralising agent is 1 μm, more preferably 4 μm, most preferably 10 μm.

By "average $d_{3,2}$ size" is meant the surface weighted mean diameter given by the equation:

$$d_{3,2} = \left[ \sum_{i}^{m} \frac{n_i D_i^3}{\sum_{i}^{m} n_i D_i^2} \right]$$

wherein $n_1$ is the number of particles in size class i $D_1$ is the median diameter value in size class i m is the number of size classes Of course, a given $d_{3,2}$ average particle size may be inherent in a commercially available raw material, or may be achieved by milling a commercial sample. It may also be achieved by mixing two or more raw materials of different morphologies.

The Granulation Apparatus

Step (i) of the invention requires use of a mechanical granulator. Preferably, this is of a type having moving impellers. Suitable such granulators include a high speed mixer/granulator such as a Lodige$^R$ CB machine or a moderate-speed mixer such as a Lodige$^R$ KM machine. Other suitable equipment includes Drais$^R$ T160 series manufactured by Drais Werke GmbH, Germany; the Littleford mixer with internal chopping blades and turbine-type miller mixer having several blades on an axis of rotation. A low- or high-shear mixer granulator often has a stirring action and/or a cutting action which are operated independently of one another. Preferred types of low- or high-shear mixer granulators are mixers of the Fukae$^R$ FS-G series; Diosna$^R$ V series ex Dierks & Sohne, Germany; Pharma Matrix$^R$ ex. T.K. Fielder Ltd, England. Other mixers which are suitable for use in the process of the invention are Fuji$^R$ VG-C series ex Fuji Sangyo Co., Japan; the Roto$^R$ ex Zanchetta & Co. srl, Italy and Schugi$^R$ Flexomix granulator.

Yet another suitable mixer is the Lodige (Trade Mark) FM series (ploughshare mixers) batch mixer ex Morton Machine Col Ltd., Scotland.

Step (ii) of the process of the present invention requires use of a low shear granulator.

A preferred low shear granulator is one of the gas fluidisation type, which comprises a fluidisation zone in which the liquid binder is sprayed into or onto the solid neutralising agent. However, a low shear bowl mixer/granulator can also be used. When the low shear granulator is of the gas fluidisation kind it may sometimes be preferable to use equipment of the kind provided with a vibrating bed.

If the low-shear granulator is of the gas fluidisation kind, then the liquid binder can be sprayed from above and/or below and/or within the midst of the fluidised material comprising the solid neutralising agent.

If a gas fluidisation granulator is used as the low-shear granulator, then preferably it is operated at a superficial air velocity of about 0.1–2.0 $ms^{-1}$, either under positive or negative relative pressure and with an air inlet temperature ranging from −10° or 5° C. up to 80° C., or in some cases, up to 200° C. An operational temperature inside the bed of from ambient temperature to 60° C. is typical. Depending on the process, it may be advantageous to vary the temperature (upwardly and/or downwards, during at least part of the process).

A low-shear granulator used in the process of the present invention may be adapted to recycle "fines", i.e. powdered or part-granular material of vary small particle size, so that they are returned to the input of the low shear granulator and/or input of any pre-mixer/granulator. Preferably the fine particulates are elutriated material, e.g. they are present in the air leaving a gas fluidisation chamber.

It is preferred to operate the fluidised bed granulator such that solid material is contacted with a spray of the liquid components to meet the requirement that the excess velocity ($U_e$) of fluidisation gas relative to the mass or volume flux of the spray ($q_{mliq}$ or $q_{vliq}$) when determined at the norma lised nozzle-to-bed distance ($D_0$) is set so that the flux number ($FN_m$ or $FN_v$) as determined by $$FN_m = \log_{10}\left[\frac{\rho_p U_e}{q_{mliq}}\right] \text{ OR } FN_v = \log_{10}\left[\frac{U_e}{q_{vliq}}\right]$$

(where $\rho_p$ is the particle density) is at a critical value of at least 2 for at least 30% of the process.

It is also preferred that $d_{3,2}$ average droplet diameter of the liquid binder dosed in step (ii) is not greater than ten times the $d_{3,2}$ average particle diameter of that fraction of the solids which has a $d_{3,2}$ particle diameter of from 20 μm to 200 μm, provided that if more than 90% by weight of the solid starting material has a $d_{3,2}$ average particle diameter less than 20 μm then the $d_{3,2}$ average particle diameter of the total solid starting materials shall be taken to be 20 μm. If more than 90% by weight of the solid starting material has a $d_{3,2}$ average particle diameter greater than 200 μm than the $d_{3,2}$ average particle diameter of the total starting solid material shall be taken to be 200 μm.

Preferably, the first liquid binder constitutes from 30% to 90%, more preferably from 60% to 80% by weight of total weight of first liquid binder plus second liquid binder. Fines elutriated in the fluid bed (step ii) can be recycled into the process via conventional methods. The fine material can be recycled into step (i) or (ii). It is preferred that material is recycled back into step (ii) (to avoid high salt loadings in step (i)).

Compositional Features

The invention also encompasses both granules and detergent compositions obtainable by a process according to the present invention.

Granules made by a process according to the present invention optionally contain one or more additional components in addition to those arising from processing of the liquid binder, aluminosilicate and inorganic salt.

In addition, granules made by a process according to the present invention may be incorporated in a detergent composition comprising one or more post dosed materials.

Solid post-dosed materials comprise powders, other granules (whether or not made by a process other than the invention) and mixtures thereof. Granules made by the process of the invention and post-dosed solids can simply be admixed or subject to further granulation by any suitable process. Post-dosed liquids are conveniently sprayed onto the granules themselves and/or onto (if present) any post-dosed solids.

Other optional components dosed in step (i) preferably constitute less than 5 wt %, more preferably less than 2 wt %, of the total of all materials dosed in step (i). Any optional components dosed in step (ii) preferably constitute less than 2%, more preferably less than 1% by weight of all materials dosed in step (ii), including the powder from step (i).

As already explained, the first and second liquid binders preferably comprise anionic and nonionic surfactants, more preferably also soap. The weight ratio of all anionic surfactant(s) to nonionic surfactants, will normally be from 20:1 to 1:20. However, this ratio may be, for example, 15:1 or less, 10:1 or less, or 5:1 or less of anionic surfactant(s) to nonionic surfactants(s). On the other hand, the nonionic may be the major component so that the ratio is 1:5 or more, 1:10 or more, or 1:15 or more of anionic surfactant(s) to nonionic surfactants(s). Ratios in the range from 5:1 to 1:5 of anionic surfactant(s) to nonionic surfactants(s) are also possible.

The anionic surfactant may actually comprise one or more different anionic surfactant compounds. The most preferred of these is alkyl benzene sulphonic acid, for example having from 10 to 14 carbon atoms on average, in the alkyl chain thereof. Other suitable anionic surfactants comprise primary alkyl sulphates and alkyl olefin sulphonates, as well as alkyl ether sulphates. In all cases, these materials preferably have on average in the aliphatic moiety thereof, from 10 to 18 carbon atoms.

Typical chain lengths of suitable soaps are from 10 to 18 carbon atoms.

Preferred nonionic surfactants are ethoxylated alcohols, e.g. having an alkyl chain from 8 to 12 carbon atoms and an average of 3 to 7 ethylene oxide groups.

Optionally, a flow aid may be introduced with the starting materials in step (i). However, it is preferred that the flow aid be added after the start of step (ii), in order to obtain to improved powder properties. Suitable flow aids include crystalline or amorphous alkali metal silicates, Dicamol, calcite, diatomaceous earth, silica, for example precipitated silica, chlorides such as sodium chloride, sulphates such as magnesium and sodium sulphate, carbonates such as calcium carbonate and phosphates such as sodium tripolyphosphate. Mixtures of these materials may be employed as desired. As used herein, for materials added during step (ii), the term "flow aid" specifically excludes aluminosilicates such as zeolites, the dosing of which is defined by claim 1.

In addition cationic, zwitterionic, amphoteric or semipolar surfactants and mixtures thereof may be added at a suitable time. In general, suitable surfactants include those generally described in "Surface active agents and detergents" Vol. I by Schwartz and Perry. If desired, soap derived from saturated or unsaturated fatty acids having, for example, $C_{10}$ to $C_{18}$ carbon atoms may also be present.

The total detergent active in the granules resulting from step (ii) is suitably present at a level of 5 to 70 wt %, preferably 10 to 50 wt % of the final granulated detergent product.

A complete detergent composition often contains a detergency builder. Aluminosilicate is an essential builder component in granules made by the process of the present invention. Such a builder may be introduced with the neutralising agent and/or added subsequently as desired. However, as already explained, some alkaline inorganic salts by themselves, or in the presence of a co-agent, can act as builders. Sodium carbonate is a typical example. Therefore, such materials may be considered as inorganic salts as hereinbefore defined.

Generally speaking, the total amount of detergency builder in the granular detergent product resulting from step (ii) is suitably from 10 to 80 wt %, preferably 15 to 65 wt % and more preferably 15 to 50 wt %.

Inorganic phosphate builders, for example, sodium orthophosphate, pyrophosphate and tripolyphosphate, may also be present.

Organic builders that may be present include polycarboxylate polymers such a polyacrylates, acrylic/maleic copolymers, and acrylic phosphinates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Citrates can also be used at lower levels (e.g. 0.1 to 5 wt %) for other purposes. The builder is preferably present in alkali metal salt, especially sodium salt form.

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Granules obtained by the process of the present invention suitably have a low bulk density in the range 400 to 900 g/l, or 500 to 800 g/l, for example, in the proximity of 650 g/l.

The composition may also comprise a post-dosed particulate filler which suitably comprises an inorganic salt, for example sodium sulphate and sodium chloride. The filler may be present at a level of 5 to 60% by weight of the composition.

A fully formulated detergent composition incorporating granules produced according to the invention might for example comprise the detergent active and builder and optionally one of more of a flow aid, a filler and other minor ingredients such as colour, perfume, fluorescer, bleaches and enzymes.

The invention will now be illustrated by the following non-limiting examples.

EXAMPLES

Example 1

The following formulation was prepared using a combination of a Lodige CB30 and Ventilex fluidised bed granulator.

The following formulation was produced:

| Ingredients | Wt % |
|---|---|
| Zeolite A24 (as received) | 43.3 |
| Sodium carbonate (light soda ash) | 17.9 |
| NaLAS | 17.3 |
| Nonionic 7EO | 15.6 |
| Soap | 2.3 |
| Water, miscellaneous | 3.6 |

In step 1, zeolite and, if applicable, sodium carbonate were fed into the CB30, whilst a pre-neutralised blend of NaLAS, nonionic, soap and water was sprayed on at a rate of approx 240 kg/h.

In step 2, the pre-granulate formed in step 2 was continuously dosed in a Ventilex fluidised bed, if applicable together with sodium carbonate. Pre-neutralised blend of the same composition as used in the CB30 was sprayed on at a rate of approx 110 kg/h.

Using this process, powders were prepared with various levels of carbonate dosed in the first step. The following table shows the properties of the powders:

| Process approach | Carbonate in step 1 [%] | Dispensing time (sec) | $D_{50}$ (μm) |
|---|---|---|---|
| Zeolite only in step 1 (Inv) | 0.0 | 13 | 760 |
| Zeolite + 25% of total soda in step 1 (Inv) | 4.5 | 21 | 703 |
| Zeolite + 37.5% of total soda in step 1 (Inv) | 6.7 | 30 | 670 |
| Zeolite + 50% of total soda in step 1 (Comp) | 9.0 | 53 | 707 |
| Zeolite + all soda in step 1 (Comp) | 18.9 | 53 | 688 |
| Zeolite + all soda in step 1 (Comp) | 18.9 | 7% residue after 60 secs | 722 |

Dispensing Test 100 gr of powder was dosed in a standard Philips dispenser (type AFG). A viewing window was made in the top of the dispenser to allow assessment of the actual dispensing time (i.e. the time when all powder had been dispensed from the dispenser). Dispensing conditions were as follows:

Water flow rate: 5 liter/min

Water temperature: 10° C.

Total dispensing was followed up to 60 second. If residue was remaining after the full dispensing time was recorded as a weight percentage of the original amount of powder.

As can be seen, if the level of sodium carbonate in the first step is less than about 9 wt %, the dispensing time deteriorates considerably. Best results are obtained when sodium carbonate in step 1 is below 5%.

Example 2

In a similar way as described for powder 1 more formulations were prepared, with the following compositions:

| Formulation | | | | | | |
|---|---|---|---|---|---|---|
| NaLAS [%] | 17.18 | 18.25 | 17.74 | 18.32 | 17.30 | 16.65 |
| Nonionic EO7 [%] | 13.64 | 14.20 | 13.83 | 14.66 | 13.84 | 13.31 |
| Soap [%] | 2.18 | 2.06 | 2.01 | 2.44 | 2.30 | 2.21 |
| Zeolite A24 (anhydrous) [%] | 41.29 | 40.59 | 39.93 | 38.89 | 40.99 | 41.94 |
| Sodium Carbonate [%] | 14.03 | 16.63 | 18.43 | 13.16 | 13.93 | 14.24 |
| Silicate (powder) [%] | 3.53 | 0.00 | 0.00 | 3.32 | 3.50 | 3.58 |
| Moisture, NDOM, salts [%] | 8.15 | 8.27 | 8.05 | 9.21 | 8.14 | 8.07 |
| Sodium carbonate in step 1 [%] | 14.03 | 4.99 | 0 | 13.16 | 0 | 0 |
| Sodium carbonate in step 2 [%] | 0 | 11.64 | 18.43 | 0 | 13.93 | 14.24 |
| Properties | | | | | | |
| BD [%] | 592 | 551 | 552 | 586 | 580 | 594 |
| DFR [%] | 129 | 126 | 128 | 134 | 133 | 132 |

-continued

| | | | | | | |
|---|---|---|---|---|---|---|
| $d_{3,2}$ (μm) | 588 | 683 | 567 | 517 | 536 | 535 |
| Dispensing time [sec] (or residue after 60 sec [wt %] | 1.2% residue | 16 | 19 | 22% residue | 28 | 17 |

It is again clear that 5% or less carbonate in step 1 give the desired fast dispensing times.

The invention claimed is:

1. A process for the preparation of detergent granules, the process comprising:

(i) a first step of admixing in a mechanical granulator, an aluminosilicate and a first liquid binder comprising at least one surfactant, to produce a powder; and (ii) a second step of admixing in a low shear gas fluidization granulator, the powder produced in step (i), a water soluble salt and a second liquid binder, to produce the said detergent granules;

wherein in step (ii), no more than 2%, preferably 0% by weight of the aluminosilicate based on the weight of the detergent granules is introduced into the low shear granulator of step (ii); and wherein no more than 9% by weight of the water soluble salt, based on the weight of the detergent granules, is introduced into the mechanical granulator of step (i).

2. A process according to claim 1, wherein the first liquid binder and second liquid binder have substantially the same composition.

3. A process according to claim 1, wherein the first and second liquid binders comprise anionic surfactant, nonionic surfactant, and preferably also, soap.

4. A process according to claim 1, wherein the first liquid binder is from 30% to 90%, preferably from 60% to 80% by weight of the total weight of first liquid binder plus second liquid binder.

5. A process according to claim 1, wherein no more than 7%, by weight of the water soluble salt, based on the weight of the detergent granules is introduced into the mechanical granulator of step (i).

6. A process according to claim 1, wherein the inorganic salt comprises sodium carbonate.

7. A process according to claim 1, wherein the amount of aluminosilicate in the detergent granules is from 10% to 60%, preferably from 15% to 50% by weight of those granules.

8. A process according to claim 1, wherein up to 90%, preferably up to 70% by weight of the aluminosilicate in the detergent granules is replaced by an insoluble absorbent powder substance.

9. A process according to claim 8, wherein the insoluble absorbent powder substance is selected from clays, silica and insoluble silicate salts.

10. A process according to claim 1, wherein no more than 0%, by weight of the water soluble salt, based on the weight of the detergent granules is introduced into the mechanical granulator of step (i).

* * * * *